US006881283B2

(12) United States Patent
Lee et al.

(10) Patent No.: US 6,881,283 B2
(45) Date of Patent: Apr. 19, 2005

(54) LOW-SENSITIVITY EXPLOSIVE COMPOSITIONS

(75) Inventors: Kenneth E. Lee, North Ogden, UT (US); Paul C. Braithwaite, Brigham City, UT (US); Steve Nicolich, Wyckoff, NJ (US); Mark Mezger, Mount Bethel, PA (US)

(73) Assignee: Alliant Techsystems Inc., Edina, MN (US)

( * ) Notice: Subject to any disclaimer, the term of this patent is extended or adjusted under 35 U.S.C. 154(b) by 14 days.

(21) Appl. No.: 10/210,863

(22) Filed: Jul. 31, 2002

(65) Prior Publication Data

US 2003/0094224 A1 May 22, 2003

Related U.S. Application Data

(60) Provisional application No. 60/309,386, filed on Aug. 1, 2001.

(51) Int. Cl.[7] ..... C06B 45/10; C06B 25/34

(52) U.S. Cl. ..... 149/19.7; 149/92

(58) Field of Search ..... 149/19.7, 45, 92

(56) References Cited

U.S. PATENT DOCUMENTS

| | | | | |
|---|---|---|---|---|
| 3,138,501 A | | 6/1964 | Wright | |
| 3,173,817 A | | 3/1965 | Wright | |
| 3,296,041 A | | 1/1967 | Wright | |
| 3,544,360 A | | 12/1970 | Gardner | |
| 4,283,237 A | * | 8/1981 | Reed, Jr. et al. | 149/19.91 |
| 4,357,185 A | | 11/1982 | Ringbloom | |
| 4,361,450 A | | 11/1982 | Munson | |
| 4,842,659 A | | 6/1989 | Mezger et al. | |
| 5,468,313 A | | 11/1995 | Wallace et al. | |
| 5,472,531 A | | 12/1995 | Turci et al. | |
| 5,487,851 A | | 1/1996 | Dillehay et al. | |
| 5,500,060 A | | 3/1996 | Holt et al. | |
| 5,529,649 A | | 6/1996 | Lund et al. | |
| 5,565,651 A | | 10/1996 | Kim et al. | |
| 5,587,553 A | | 12/1996 | Braithwaite et al. | |
| 5,623,116 A | | 4/1997 | Hamilton et al. | |
| 5,690,868 A | | 11/1997 | Strauss et al. | |
| 5,712,511 A | | 1/1998 | Chan et al. | |
| 5,716,557 A | | 2/1998 | Strauss et al. | |

(Continued)

FOREIGN PATENT DOCUMENTS

| | | |
|---|---|---|
| DE | 36 14 173 C | 3/1989 |
| EP | 0 968 983 | 1/2000 |
| WO | WO 94/18144 | 8/1994 |
| WO | WO 98 21168 | 5/1998 |
| WO | WO 99 18050 | 4/1999 |
| WO | WO 99/18050 | 4/1999 |
| WO | WO 00/44689 | 8/2000 |
| WO | WO 00/52011 | 9/2000 |

OTHER PUBLICATIONS

Wardle et al., Synthesis of the caged nitramine HNIW (CL–20), p. 301, XP 000664704 Chemical Abstracts, vol. 125, No. 14, Sep. 30, 1996.

Chemical Abstracts, vol. 129, No. 11, P. Gerber et al., "Fine Grinding of Explosives", Int. Annu. Conf. ICT (Sep. 14, 1998).

*Primary Examiner*—Aileen B. Felton
(74) *Attorney, Agent, or Firm*—TraskBritt

(57) ABSTRACT

An explosive composition is provided that includes 85 to about 96 weight percent nitramine, based on the total composition weight, and about 4 to 15 weight percent plasticized binder. At least 80 weight percent of the total composition weight, and more preferably 85 to 96 weight percent of the total composition weight, comprises 2,4,6,8,10,12-hexanitro-2,4,6,8,10,12-hexaazatetracyclo[5.5.0.0$^{5,9}$0$^{3,11}$]-dodecane (CL-20) particles having an average particle size not greater than 30 microns as the nitramine. Methods for preparing an explosive from the explosive composition are also provide.

20 Claims, 3 Drawing Sheets

U.S. PATENT DOCUMENTS 5,750,920 A 5/1998 Redecker et al.
5,759,458 A * 6/1998 Haaland et al. ..... 264/3.3
5,798,481 A 8/1998 Manning et al.
5,874,574 A 2/1999 Johnston et al.
6,168,677 B1 * 1/2001 Warren ..... 149/19.4
6,214,137 B1 4/2001 Lee et al.
6,217,799 B1 4/2001 Lee et al.
6,315,847 B1 11/2001 Lee et al.

* cited by examiner

LOW-SENSITIVITY EXPLOSIVE COMPOSITIONS

RELATED APPLICATION

This application claims the benefit of priority of U.S. Provisional Application No. 60/309,386, filed in the U.S. Patent & Trademark Office on Aug. 1, 2001, the complete disclosure of which is incorporated herein by reference.

GOVERNMENT LICENSE RIGHTS

The U.S. Government has a paid-up license in this invention and the right in limited circumstances to require the patent owner to license others on reasonable terms as provided for by the terms of DAAE30-98-D-1005 awarded by the Picatinny Arsenal of the U.S. Army.

BACKGROUND OF THE INVENTION

Field of the Invention: This invention relates to the field of explosives, especially explosives having low sensitivity to impact. More particularly, the invention is directed to compositions loaded with high concentrations of 2,4,6,8,10,12-hexanitro-2,4,6,8,10,12-hexaazatetracyclo[$5.5.0.0^{5,9}0^{3,11}$]dodecane, which is also known in the art and referred to herein as HNIW and, more commonly, CL-20. This invention is also directed to a process for making the explosive.

State of the Art: Nitramines are highly energetic compounds that have found acceptance in the art of explosives. Perhaps the most common nitramines in use in the explosives art today are 1,3,5-trinitro-1,3,5-triaza-cyclohexane (RDX) and 1,3,5,7-tetranitro-1,3,5,7-tetraaza-cyclooctane (HMX).

Another energetic nitramine that has found acceptance in the art is CL-20, which has a higher energetic performance than either RDX or HMX. The explosive composition LX-19, which is a combination of CL-20 and ESTANE ($C_{5.14}H_{7.5}N_{0.187}O_{1.76}$), is considered by many to be the current standard by which other explosives containing CL-20 are measured. Other examples of explosive compositions containing CL-20 as a primary energetic filler are disclosed in U.S. Pat. No. 6,214,137, entitled "High Performance Explosive Containing CL-20" and U.S. Pat. No. 6,217,799, entitled "Method for Making High Performance Explosive Formulations Containing CL-20."

Although energetic performance is a crucial feature of energetic compositions, another important performance criteria by which explosive compositions are evaluated is shock sensitivity. An acceptably low shock sensitivity is extremely important to avoid accidental detonation, avoid hazardous conditions, and ensure the safe handling, shipment, and use of the material.

One test accepted in the art for measuring shock sensitivity is known as the Large Scale Gap Test (LSGT), in which a test material is placed into a metal tube on top of a witness plate. A predetermined number of PMMA (polymethylmethacrylate) cards are placed between the top of the metal tube and a booster material, which typically consists of 50 weight percent PETN (pentaerythritol tetranitrate) and 50 weight percent TNT (trinitrotoluene), available as Pentolite. The distance between the booster and the metal tube is expressed in cards, where one card is equal to 0.0254 cm (0.01 inch), such that 100 cards equal 2.54 cm (1 inch). A card gap measurement is the minimum number of cards required to prevent the booster from detonating the explosive sample, so that the sample does not blow a hole through the witness plate. Thus, the lower the card value, the lower the shock sensitivity of the explosive composition. The LSGT (or NOL Card Pipe Test) is more fully described in the Joint Technical Bulletin, Navy document number NAVSEA INST 8020.8B, Air Force technical order 11A-1-47, Defense Logistics Agency regulation DLAR 8220.1, and Army technical bulletin TB700-2.

LX-14, which is a combination of the more stable nitramine HMX and ESTANE, has an NOL card gap of 193 cards. The explosives disclosed in U.S. Pat. No. 6,214,137 and U.S. Pat. No. 6,217,799 exhibited similar shock sensitivities to LX-14.

SUMMARY OF THE INVENTION

The present invention provides an explosive composition having excellent energetic performance, yet shock sensitivity that is superior to that of the current CL-20 standard, LX-19.

Further, the present invention provides a method for preparing the explosive composition of this invention.

In accordance with the present invention, as embodied and broadly described in this document, an explosive composition according to one aspect of the invention comprises a high loading of 85 weight percent to about 96 weight percent 2,4,6,8,10,12-hexanitro-2,4,6,8,10,12-hexaazatetracyclo[$5.5.0.0^{5,9}0^{3,11}$]-dodecane (CL-20) and about 4 weight percent to 15 weight percent of a plasticized binder. The CL-20 particles are fine, meaning that the particles have an average particle size of not greater than 30 microns, more preferably an average particle size of not greater than 10 microns, still more preferably an average particle size of 1 micron to 4 microns, and still more preferably an average particle size of 1 micron to 2 microns.

In a particularly preferred aspect of the invention, substantially all of the particles are fine. More specifically, 100 percent of the CL-20 particles have a particle size less than 30 microns, more preferably 100 percent of the CL-20 particles have a particle size less than 10 microns, and still more preferably 100 percent of the CL-20 particles have a particle size less than 4 microns.

The inventors have discovered that even with a very high CL-20 loading of at least 85 weight percent, using a very fine distribution of CL-20 particles surprisingly reduces shock sensitivity of the explosive well below conventional CL-20 explosives containing bimodal and multimodal distributions of fine and coarse particles. In a particularly preferred embodiment of the invention, the shock sensitivity is reduced to under 140 cards, as measured by the NOL Card Gap Test.

In one particularly preferred embodiment of the invention, the fine CL-20 particles constitute 85 weight percent to 95 weight percent of the total composition weight and, more preferably, 94 weight percent to 95 weight percent of the total composition weight.

In another preferred embodiment, the plasticized binder comprises cellulose acetate butyrate and bis-dinitropropyl acetal/bis-dinitropropyl formal.

In accordance with another aspect of the invention, the explosive composition comprises 85 weight percent to about 96 weight percent nitramine based on the total composition weight, with at least 80 weight percent of the total composition weight comprising 2,4,6,8,10,12-hexanitro-2,4,6,8,10,12-hexaazatetracyclo[$5.5.0.0^{5,9}0^{3,11}$]-dodecane (CL-20) particles having an average particle size not greater than 30 microns, more preferably not greater than 10 microns, and still more preferably 1 micron to 4 microns. About 4 weight percent to 15 weight percent of the explosive composition comprises a plasticized binder.

In accordance with another aspect of the invention, a method for preparing an explosive is provided. The method comprises combining 2,4,6,8,10,12-hexanitro-2,4,6,8,10,12-hexaazatetracyclo[5.5.0.0$^{5,9}$0$^{3,11}$]-dodecane (CL-20) particles having an average particle size not greater than 30 microns with a plasticized binder to form an explosive composition. The explosive composition is granulated to form the explosive, which comprises 85 weight percent to about 96 weight percent of the CL-20 particles and about 5 weight percent to 15 weight percent of the plasticized binder.

Another aspect of the invention is provided in which an explosive is prepared by providing an aqueous dispersion comprising epsilon polymorph CL-20 particles having an average particle size not greater than 30 microns, more preferably not greater than 10 microns, and still more preferably 1 micron to 4 microns. The aqueous dispersion is combined with a lacquer comprising a plasticized binder to form a slurry, which is agitated and from which solvent is removed to form coated granules. The coated granules are dried to provide an explosive having a high load of 85 weight percent to about 96 weight percent CL-20 and about 5 weight percent to 15 weight percent of the plasticized binder.

Additional aspects and advantages of the invention will be set forth in the description of the preferred embodiments and methods that follows and, in part, will be apparent from the description or may be learned by practice of the invention. The aspects and advantages of the invention may be realized and obtained by means of the instrumentalities and combinations pointed out in the appended claims.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF THE INVENTION

Reference will now be made in detail to the presently preferred embodiments and methods of the invention as described below. It should be noted, however, that the invention in its border aspects is not limited to the specific details, representative devices and methods, and examples described in this section in connection with the preferred embodiments and methods. The invention, according to its various aspects, is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

In accordance with one preferred embodiment of this invention, an explosive composition is provided that comprises 85 weight percent to about 96 weight percent 2,4,6,8,10,12-hexanitro-2,4,6,8,10,12-hexaazatetracyclo[5.5.0.0$^{5,9}$0$^{3,11}$]-dodecane (CL-20) and about 4 percent to 15 weight percent of a plasticized binder.

The production of CL-20 is well known in the art and is described in various publications, including WO 00/52011. U.S. Pat. No. 5,874,574 teaches the crystallization of CL-20 into its epsilon polymorph. In the context of preferred embodiments of this, invention, epsilon-polymorph CL-20 is selected, although the presence of small and expected amounts of impurities (e.g., other CL-20 polymorphs) are acceptable and within the scope of the preferred embodiments of the invention.

Figure 3:
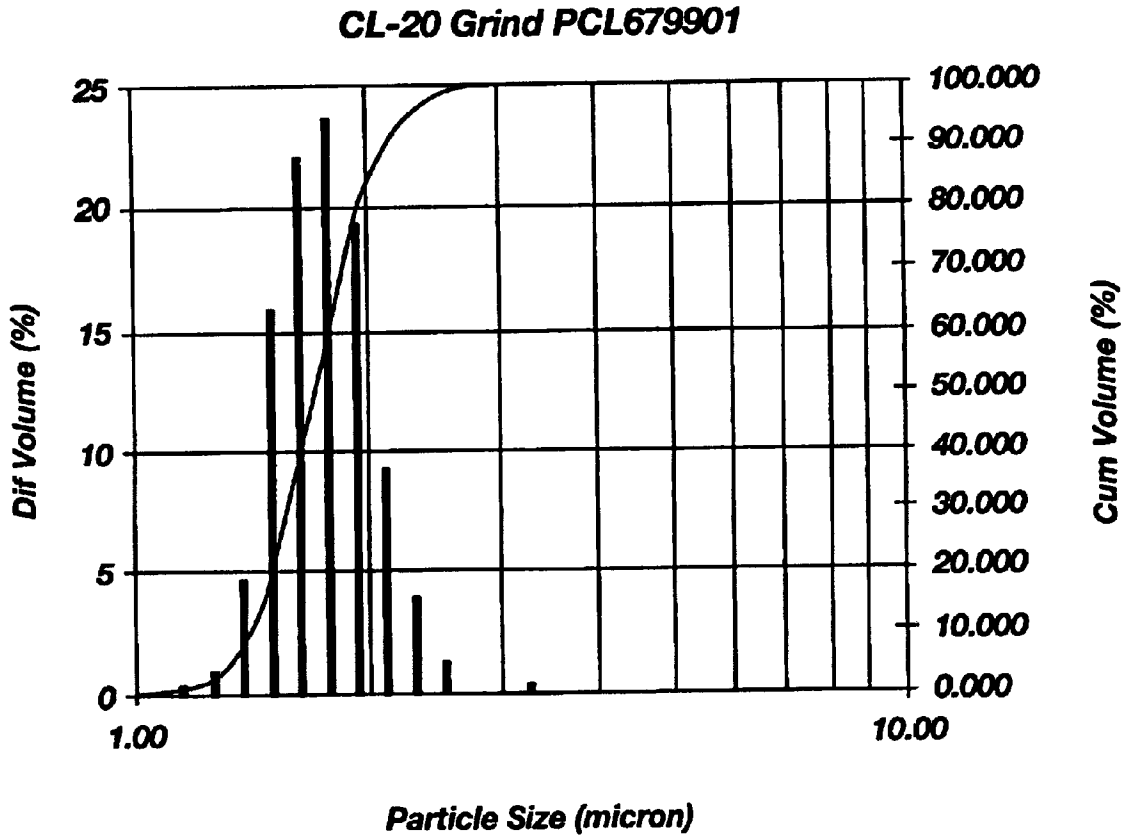
FIG. 3 is a graph of an exemplary particle size distribution of CL-20 particles in accordance with an embodiment of the invention.

The CL-20 particles of this invention are fine, meaning that they have an average particle size of not more than 30 microns, preferably not more than 10 microns, and more preferably the average particle size is 1 micron to 4 microns. It is especially preferred that the average particle size be 1 micron to 2 microns. Average sizes of CL-20 particles may be determined by use of a Microtrac instrument available from Microtrac, Inc., previously available from Leeds & Northrup, as part SRA-150. It is preferred that 100 percent of the CL-20 particle distribution in the composition is less than 30 microns, more preferably 100 weight percent of the CL-20 particles is less than 10 microns, and still more preferably 100 weight percent of the CL-20 particle distribution is less than 4 microns in particle size. One particularly preferred particle size distribution of about 2 microns is shown in FIG. 3.

The incorporation of other nitramines into the explosive composition is optional. Exemplary nitramines that can be used with CL-20 for this invention include, by way of example, 1,3,5-trinitro-1,3,5-triaza-cyclohexane (RDX), 1,3,5,7-tetranitro-1,3,5,7-tetraaza-cyclooctane (HMX), and 4,10-dinitro-2,6,8,12-tetraoxa-4,10-diazatetracyclo-[5.5.0.0$^{5,9}$0$^{3,11}$]-dodecane (TEX). However, the fine CL-20 particles account for at least 80 weight percent of the explosive composition when other nitramines are used, with the total nitramine content at 85 weight percent to about 96 weight percent.

The plasticized binder comprises at least one plasticizer and at least one binder component, which is preferably a polymer. Exemplary polymeric binder components are non-energetic and include at least one of the following: cellulose acetate butyrate (CAB), nylon, HYTREL® 8184 (polybutylene phthalate available from I.E. DuPont Nemours & Company), PEBAX® (polyether block amide available from ELF Atochem of Philadelphia, Pa.), and fluorocarbons such as FLUOREL® from 3M. The nylon binder may be, for example, 6-polyamide, 6,6-polyamide, 11-polyamide, 1,2-polyamide, or any copolymer or blend thereof.

Representative plasticizers include isodecyl pelargonate (IDP), bis-dinitropropyl acetal and bis-dinitropropyl formal (BDNPA/F), and glycidyl azide polymer (GAP). In the event that BDNPA/F is selected as the plasticizer, the weight ratio of bis-dinitropropyl acetal to bis-dinitropropyl formal is preferably between about 45:55 and about 55:45, and more preferably is about 50:50. The plasticizer is preferably a liquid.

A preferred plasticized binder according to this invention comprises a combination of CAB and BDNPA/F, preferably in a weight ratio of 40:60.

Among the additives that may be included in the composition are metals such as aluminum, boron, and magnesium.

In one preferred embodiment, the composition comprises about 94 weight percent to about 95 weight percent CL-20 particles having an average particle size in a range of 1to 4 microns, about 2 weight percent to about 2.8 weight percent CAB, and about 3.2 weight percent to about 4 weight percent BDNPA/F. In a still more preferred embodiment, the composition comprises about 94 weight percent CL-20 having an average particle size of 1 micron to 4 microns, about 2.4 weight percent CAB, and about 3.6 weight percent BDNPA/F. In view of the large surface area of the fine CL-20 particles, it was particularly surprising that the fine CL-20 particles in high loadings of 94 to 95 weight percent could be effectively coated with the plasticized binder.

The explosive is preferably sufficiently pressable or extrudable to permit its formation into grains and billets suitable for ordnance and similar applications. The principles of the present invention outlined above are applicable to making a variety of explosive articles but have particular applicability to the formation of pressed or injection-loaded ordnances such as grenades, land mines, missile warheads, and demolition explosives.

An exemplary water slurry process for making the explosive of this invention will be described below. It should be understood that this invention is not limited to the described process; rather, other methods and processes may be practiced within the scope of this invention.

Figure 1:
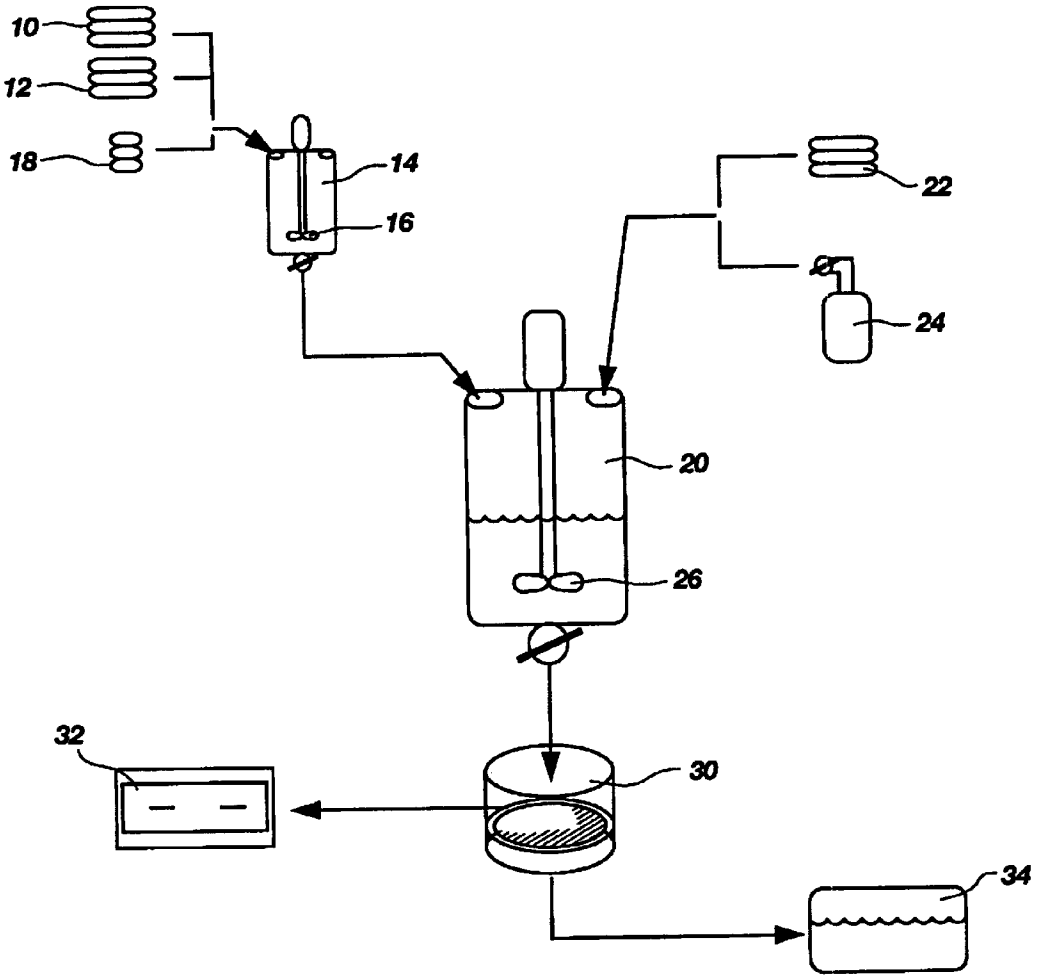
FIG. 1 is a schematic of one example of a slurry emulsion process suitable for preparing the inventive explosive composition.

Referring now more particularly to FIG. 1, there is shown a batchwise process for preparing the explosive of this invention. The process may be conducted at or near room temperature. In the illustrated process, a polymer and plasticizer from which the plasticized binder is comprised are charged from separate tanks 10 and 12 into a lacquer mixing vessel 14 equipped with stirrer 16. For purposes of illustration, the stirrer 16 is depicted as an impeller. Although not shown, as an alternative, the plasticized binder components may be premixed and charged from a single tank.

Solvent is fed to the lacquer mixing vessel 14 from storage tank 18. Representative solvents that may be used in this process include one or more of the following: low molecular weight hydrocarbons, such as straight chain hydrocarbons (e.g., hexane and heptane) and cyclic hydrocarbons (e.g., cyclohexane and cycloheptane); low molecular weight alcohols, such as methanol, ethanol, propanol, isopropanol, and butanol; and esters such as ethyl acetate. Ethyl acetate is currently the preferred solvent for this process.

Although not shown, a stabilizer may be added to the lacquer mixing vessel 14. Representative stabilizers include diphenyl amine and n-alkyl nitroanilines, in which the n-alkyl group may be, for example, methyl, ethyl, and other low molecular weight moieties such as isopropyl.

Surfactants may also be added into the jacketed mixer 20. Suitable surfactants include, by way of example, low molecular weight alcohols, such as 1-butanol and isopropyl alcohol. It has been found that 1-butanol has synergistic effects with CL-20 in regard to its defoaming capability. The amount of surfactant introduced into the process should be sufficient to reduce foaming and produce a yield of at least 99 weight percent.

Figure 2:
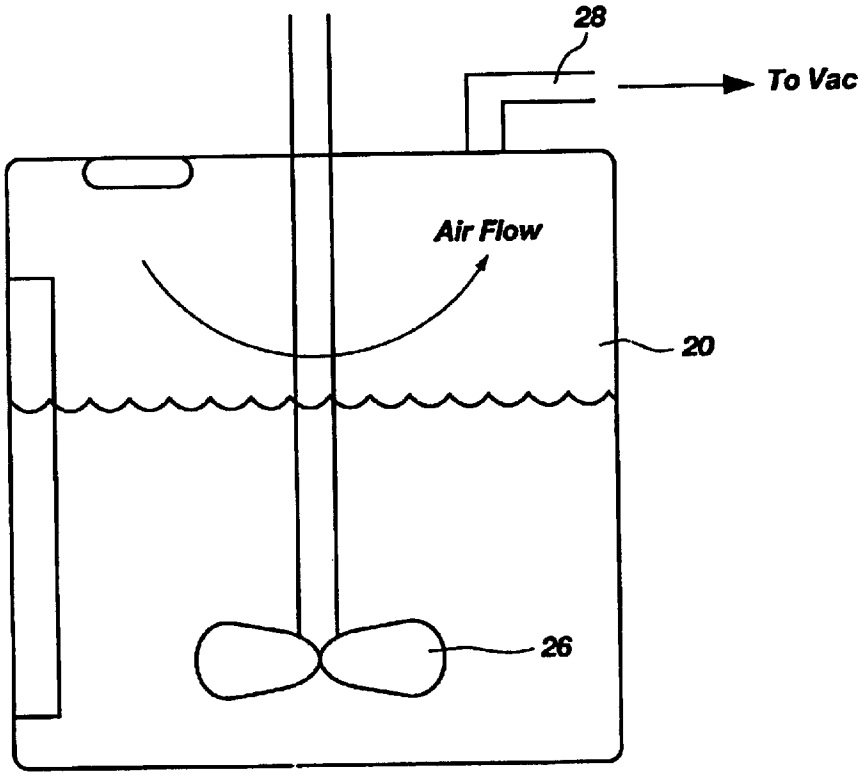
FIG. 2 is a schematic sectional view of a jacketed mixer suitable for use in the process illustrated in FIG. 1.

An aqueous dispersion is prepared by charging CL-20 from storage tank 22 and water from tank 24 into a jacketed mixer 20 equipped with stirrer 26, which is depicted as an impeller. Then, the lacquer from mixing vessel 14 is fed into the jacketed mixer 20 to form CL-20 granules and precipitate the plasticized binder on the CL-20 granules. The granules begin to take shape as the lacquer is added to the jacketed mixer 20 and have, for the most part, taken their final form by the time the lacquer addition is completed. Referring to FIG. 2, during stirring of the granules an air sweep may be passed through the jacketed mixer 20. The air sweep removes solvent, surfactant, and water from the jacketed mixer 20 through vent 28. The granules may then be further rinsed with water while stirring is continued to prevent unacceptable amounts of agglomeration.

The amount of water fed into the jacketed mixer 20 should sufficiently dilute the lacquer from mixing vessel 14, thereby preventing granules from sticking to the walls of the jacketed mixer 20 and agglomerating. On the other hand, if too much water is added to the jacketed mixer 20, the growth rate of the granules may be impeded, resulting in small and highly sensitive granules. Generally, the weight ratio of CL-20 to water may be about 2.5:1 to about 4.5:1 and, more preferably is about 3:1.

The amount of solvent fed into the jacketed mixer 20 should be sufficient to facilitate mixing and dilution of the CL-20. However, excess solvent may cause a significant amount of the CL-20 to dissolve and may add significant cost towards minimizing environmental impact of waste streams. Generally, the amount of solvents used in the process depends upon many variables, including the solvent selected, the concentration of CL-20, and the plasticized binder selected. When viewed in reference to this disclosure, ascertaining suitable solvent concentrations is within the purview of those of ordinary skill in the art without undue experimentation. By way of example, the weight ratio of water to ethyl acetate may be about 6.3:1 for a CL-20 concentration of 90 weight percent and 9.6:1 for a CL-20 concentration of 94 weight percent.

The addition rate of the lacquer to the CL-20 aqueous dispersion may be selected to facilitate the formation of round and hard CL-20 granules. Due to the large surface areas of the fine CL-20 particles, lacquer is preferably added quickly to ensure coating. Preferably, the granular agglomerates are from about 0.85 mm to about 4 mm in size. The temperature at which the process is conducted is dependent upon the solvent and, in particular, should not be higher than the boiling point of the solvent. Also, the temperature should be maintained within reasonable limits to avoid polymorph conversion of the CL-20, which preferably remains as epsilon polymorph throughout the process. The temperature may be within a range of from about 30° C. to about 50° C., and more preferably may be room temperature. Generally, the steps of combining the CL-20 aqueous dispersion with the lacquer and agitating are conducted at a sufficiently low temperature and the solvent is present in a sufficiently low concentration to avoid significant polymorph conversion of the epsilon-polymorph CL-20.

The granules formed in the jacketed mixer 20 and water are poured on a primary filter 30 for drying. The granules are then passed to an oven or dryer 32 and spread out and subjected to a vacuum for at least about 24 hours at, for example, about 49° C. to 54° C. Excess solvent is passed to waste tank 34. Although not shown in the figures, for larger scale processes, a secondary recovery system (e.g., filters, vacuum collection tanks, heat exchangers, and the like) may be used.

The following examples serve to explain embodiments of the invention in more detail. These examples are not to be construed as being exhaustive or exclusive as to the scope of this invention.

The CL-20 used in the examples and comparative examples was of the epsilon polymorph type. The CL-20, supplied by ATK Thiokol Propulsion Corp. of Promontory, Utah, was crystallized using a nonchlorinated solvent process as described in U.S. Pat. No. 5,874,574, the complete disclosure of which is incorporated herein by reference. The particles were subjected to dry grinding in a fluid energy mill to give their desired size as the feed stock.

EXAMPLES

Example 1 was prepared as follows: 478 grams of CAB were dissolved in 6100 grams of ethyl acetate. 750 grams of BDNPA/F were stirred into the CAB solution to provide a lacquer with the plasticized binder. CL-20 particles having a distribution shown in FIG. 3 were slurried in 1.5 gallons of water and 375 grams of n-butanol. A 20 gallon slurry mixer was then charged with 8.5 gallons of water, and the water temperature was maintained at 90° F. to 95° F. The slurried CL-20 was then added to the slurry mixer operating at an impeller rate of 450 rpm. 0.5 to 1.0 gallons of water were then added to the slurry mixer, then 1000 grams of n-butanol were added. The blower was started at 50% capacity to draw air over the slurry in the slurry mixer. The impeller rate was then increased to 1150 rpm, and 75% of the lacquer containing the plasticized binder was added over a three-minute period. The blower was increased to 100% capacity and the impeller rate was adjusted to form and mix the granules. The remaining 25% of the lacquer was then added over a 25-minute period. Fifteen minutes after the lacquer had been added, 200 grams of ethyl acetate were added. Ten minutes later, 5 gallons of water were added and the granules were removed from the mixer through a bottom valve and screened.

The following examples were prepared using the water slurry process described above and illustrated in the accompany figures. For Example 2, CL-20 particles having a size distribution shown in FIG. 3 were used. Comparative Examples A and B used a combination of fine CL-20 particles with larger coarse particles of 70 microns to 350 microns. In Comparative Example A, 90 weight percent of the CL-20 particles were fine (having the distribution of FIG. 3) and 10 weight percent of the CL-20 particles were coarse. Comparative Example B used 95 weight percent fine CL-20 (having the distribution of FIG. 3) and 5 weight percent coarse CL-20 particles. Each of Example 2 and Comparative Examples A and B had a 90 weight percent CL-20 concentration and a 10 weight percent plasticized binder of CAB and BDNPA/F.

The NOL card gap number of Example 2 was found to be about 137. On the other hand, Comparative Examples A and B both detonated at 140 cards, 150 cards, and 160 cards, These results indicate that even with just 5 weight percent large CL-20 particles, the shock sensitivity was increased greatly.

The forgoing detailed description of the preferred embodiments of the invention has been provided for the purposes of illustration and description and is not intended to be exhaustive or to limit the invention to the precise embodiments disclosed. The embodiments were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

What is claimed is:

1. An explosive composition having a total composition weight, the explosive composition comprising:

greater than 85 weight percent to about 96 weight percent 2,4,6,8,10,12-hexanitro-2,4,6,8,10,12-hexaazatetracyclo[5.5.0.0$^{5,9}$0$^{3,11}$]-dodecane (CL-20) particles based on the total composition weight, the CL-20 particles having an average particle size not greater than 30 microns; and about 4 weight percent to less than 15 weight percent of a plasticized binder.

2. The explosive composition of claim 1, wherein the average particle size of the CL-20 particles is not greater than 10 microns.

3. The explosive composition of claim 1, wherein the average particle size of the CL-20 particles is in a range of 1 micron to 4 microns.

4. The explosive composition of claim 1, wherein the average particle size of the CL-20 particles is 1 micron to 2 microns.

5. The explosive composition of claim 1, wherein 100 percent of the CL-20 particles have a particle size less than 10 microns.

6. The explosive composition of claim 1, wherein 100 percent of the CL-20 particles have a particle size less than 4 microns.

7. The explosive composition of claim 1, wherein the CL-20 particles constitute greater than 85 weight percent to 95 weight percent of the total composition weight.

8. The explosive composition of claim 1, wherein the CL-20 particles constitute 94 weight percent to 95 weight percent of the total composition weight.

9. The explosive composition of claim 1, wherein the plasticized binder comprises cellulose acetate butyrate and bis-dinitropropyl acetal/bis-dinitropropyl formal.

10. The explosive composition of claim 1, wherein the explosive composition has a shock sensitivity under 140 cards, as measured by the NOL Card Gap Test.

11. An explosive composition having a total composition weight, the explosive composition comprising:

greater than 85 weight percent to about 96 weight percent nitramine based on the total composition weight, with at least 80 weight percent of the total composition weight comprising 2,4,6,8,10,12-hexanitro-2,4,6,8,10,12-hexaazatetracyclo[5.5.0.0$^{5,9}$0$^{3,11}$]-dodecane (CL-20) particles having an average particle size not greater than 30 microns; and about 4 weight percent to less than 15 weight percent of a plasticized binder.

12. The explosive composition of claim 11, wherein the average particle size of the CL-20 particles is not greater than 10 microns.

13. The explosive composition of claim 11, wherein the average particle size of the CL-20 particles is in a range of 1 micron to 4 microns.

14. The explosive composition of claim 11, wherein the average particle size of the CL-20 particles is 1 micron to 2 microns.

15. The explosive composition of claim 11, wherein 100 percent of the CL-20 particles have a particle size less than 10 microns.

16. The explosive composition of claim 11, wherein 100 percent of the CL-20 particles have a particle size less than 4 microns.

17. The explosive composition of claim 11, wherein the CL-20 particles constitute greater than 85 weight percent to 95 weight percent of the total composition weight.

18. The explosive composition of claim 11, wherein the CL-20 particles constitute 94 weight percent to 95 weight percent of the total composition weight.

19. The explosive composition of claim 11, wherein the plasticized binder comprises cellulose acetate butyrate and bis-dinitropropyl acetal/bis-dinitropropyl formal.

20. The explosive composition of claim 11, wherein the explosive composition has a shock sensitivity under 140 cards, as measured by the NOL Card Gap Test.

* * * * *